US006086316A

United States Patent [19]

Sundermeijer

[11] Patent Number: 6,086,316

[45] Date of Patent: Jul. 11, 2000

[54] CONTAINER HANDLING ASSEMBLY

[75] Inventor: Jan Sundermeijer, Calamvale, Australia

[73] Assignee: Hyco-Cascade PTY LTD, Rocklea, Australia

[21] Appl. No.: 09/191,590

[22] Filed: Nov. 13, 1998

Related U.S. Application Data

[63] Continuation of application No. PCT/AU96/00088, Feb. 21, 1996.

[51] Int. Cl.[7] ..... B66F 9/18

[52] U.S. Cl. ..... 414/622; 414/607; 294/110.1; 294/119.1; 294/81.54; 294/81.51

[58] Field of Search ..... 414/607, 618, 414/619, 622, 620, 621, 623; 294/81.51, 106, 81.54, 110.1, 119.1, 81.6, 81.62, 81.61; 254/2 R, DIG. 4

[56] References Cited

U.S. PATENT DOCUMENTS

| | | | |
|---|---|---|---|
| 3,809,270 | 5/1974 | Peltonen | 294/81.51 X |
| 4,029,229 | 6/1977 | Hobson | 414/622 |
| 4,546,891 | 10/1985 | Lanigan, Sr. et al. | 294/81.54 X |

*Primary Examiner*—Frank E. Werner
*Attorney, Agent, or Firm*—Cantor Colburn LLP

[57] ABSTRACT

A container handling assembly for lifting one or two containers. The assembly comprises a first and second jaw captively connected for cooperative movement whereby the jaws close when a load is applied. If a single container is lifted on the first jaw, the second jaw pivots to clamp the container on the first jaw. If two containers are lifted the jaws close to safely clamp both containers. In the unloaded position the second jaw projects beyond the first jaw thereby facilitating insertion of the jaws into coupling pieces of containers to be lifted. A number of safety features are incorporated to prevent lifting unless the containers are correctly loaded and to prevent unloading unless a release is activated.

17 Claims, 5 Drawing Sheets

CONTAINER HANDLING ASSEMBLY

CROSS-REFERENCE TO RELATED APPLICATIONS

This application is a continuation of International Application Ser. No. PCT/AU96/00088 filed Feb. 21, 1996.

FIELD OF THE INVENTION

This invention relates to a container handling assembly for a forklift. In particular, it relates to an assembly to be attached to a forklift for grabbing and lifting one or two containers for placing on top of other containers.

BACKGROUND OF THE INVENTION

Large containers have become common place for the bulk transport of goods. Conventional containers are typically hollow metal rectangular prisms with a pair of doors opening one end. When not in use the containers are stored in multiple stacks. These stacks may be as many as eight containers high.

In order to stack the containers they must be lifted by a forklift to the top of the stack. Specialised forklift attachments have been developed for this task. Most of these attachments grab the containers at coupling pieces provided at the corners.

A variety of different mechanisms have been devised for grabbing the containers. Many of the prior art mechanisms lift single containers only. One example is described in U.S. Pat. No. 5,382,067 which discloses a side latch assembly that grabs a container from above. The side latch assembly incorporates a hook that engages the coupling piece at the corner of the container.

Other container lifting assemblies utilise twist lock mechanisms to engage the corner pieces of the container. An example of this type of container handling assembly is found in the specification of Australian patent application number 71330/91.

Prior art mechanisms that lift only a single empty container at a time can cause unnecessary delays in loading and unloading operations. In order to speed up operations it is desirable to lift and stack two containers at a time. For many prior art assemblies this is not possible because the latch mechanism extends above the container. Lifting of two containers is only possible with those mechanisms that access the coupling pieces from the front of the container. However, the use of these mechanisms is dangerous since the upper of the two containers is not held by the mechanism. The upper container can easily shift during movement, at best resulting in an uneven stack, and at worst resulting in damage or injury.

The safety problem has been partly overcome by lift assemblies that incorporate a pair of latch assemblies to engage the coupling pieces of both the upper and lower containers. Such an assembly is described in European patent application number 0638512 in the name of Mandigers BV. This patent application describes a carry device for picking up two containers placed one on top of the other. Coupling means are arranged in pairs such that a coupling means is inserted to the coupling piece of each container. The pair of coupling means are pivotally connected to a frame of the carrying device.

The Mandigers assembly has a number of shortcomings. It requires an hydraulic actuating piston to operate the upper coupling means thereby requiring a supply of hydraulic pressure to be supplied into the lifting head This can limit the maximum height extent of the lifting mechanism. Furthermore, as the height to which the containers are lifted is increased the positioning of the coupling means into the coupling piece becomes very difficult. With the Mandigers assembly it is possible for the containers to move with respect to each other and to become dislodged from the coupling means.

OBJECT OF THE INVENTION

It is an object of the present invention to provide a container handling assembly that can safely grab and lift one or two containers onto and from a stack of containers.

It is a further object to provide a container lift assembly that overcomes one or more of the deficiencies identified in the prior known art.

Further objects will be evident from the following description.

SUMMARY OF THE INVENTION

In one form, although it need not be the only or indeed the broadest form, the invention resides in a container handling assembly comprising:

a body;

a first jaw member slidably connected to the body;

a second jaw member pivotally connected to the body and slidable between an extended and a retracted position, said pivotal connection being adjacent one end of the second jaw member; and connection means captively connecting the first and second jaw members, said connection means being pivotally connected to the first jaw member and capturing the second jaw member intermediate the ends thereof, whereby a load applied to the first jaw member causes the first and second jaw members to move towards a closed position.

The body of the container handling assembly is preferably adapted for attachment to a conventional lift mechanism of a forklift truck.

The second jaw member is preferably movable between an extended position and a retracted position and there is suitably bias means that biases the second jaw member towards the extended position.

To enhance operability when placing or collecting containers at the top of a stack of containers the second jaw member when in the extended position may project beyond the first jaw member.

The first and second jaw members are preferably biased towards an open position by a spring means acting on the first jaw member.

In preference the jaw members are self adjusting to account for misalignment of containers in either a transverse or lateral direction, or both.

In a further form the invention resides in a container handling assembly comprising:

a body for attachment to a lift mechanism of a forklift truck;

a first jaw member for engaging a coupling piece of a lower container;

a second jaw member for engaging a coupling piece of an upper container placed above the lower container, said second jaw member being pivotally connected to the body adjacent one end of the second jaw member; and connection means captively connecting the first and second jaw members, said connection means being pivotally connected to the first jaw member and capturing the second jaw member intermediate the ends thereof, whereby when the first and second jaw members engage the upper and lower containers respectively, and the body is raised by the lift mechanism the first and second jaw members move towards a closed position.

BRIEF DESCRIPTION OF THE DRAWINGS

To assist in understanding the invention preferred embodiments will now be described with reference to the following figures in which.

DETAILED DESCRIPTION

Figure 1:
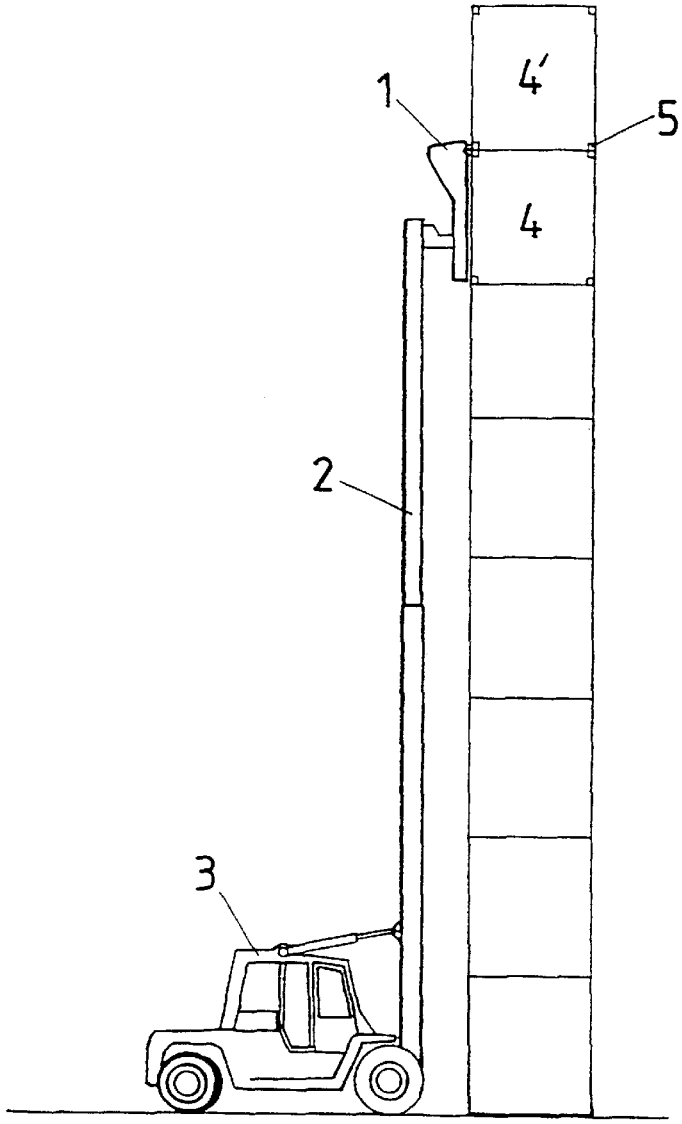
FIG. 1 is a sketch of a fork lift truck including a container handling assembly lifting two containers.
Figure 2:
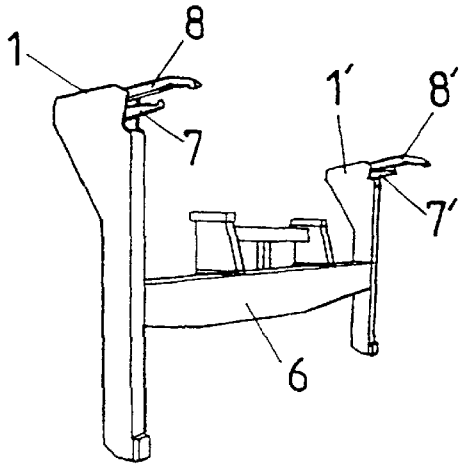
FIG. 2 is a sketch of the container handling assembly of FIG. 1.

Referring to FIG. 1, there is shown a container handling assembly 1 fitted to the lift 2 of a fork lift truck 3. The handling assembly 1 grabs a lower container 4 and an upper container 4' placed upon the lower container 4. The containers 4 have a plurality of coupling pieces, such as 5, located at each corner. The containers are of conventional rectangular prism design. As shown in FIG. 1, the containers can be stacked up to eight containers high.

In practice a pair of handling assemblies 1, 1' separated by a spreader beam 6 are fitted to the lift 2. The spreader beam 6 is adjustable by hydraulic means (not shown) to vary the separation between lift assemblies 1 and 1' to suit the size of the container 4 to be lifted. The handling assembly 1 incorporates a first jaw member 7 and a second jaw member 8 disposed above the first jaw member.

Figure 3:
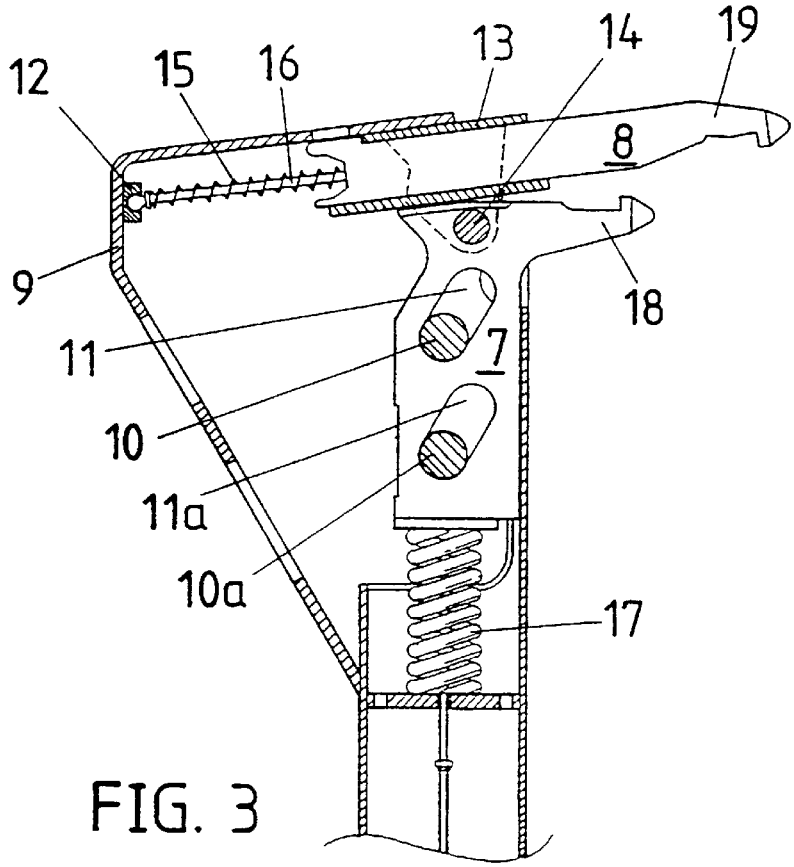
FIG. 3 is a detailed view of a first embodiment of the handling assembly of FIG. 1 in the unloaded position.

The handling assembly 1 is shown in detail in FIG. 3. The assembly comprises a body 9 which is attached to the lift mechanism 2 of the lift truck 3. The first jaw member 7 is able to slide on cams 10, 10*a* connected to the body 9. Apertures 11, 11*a* cut in the first jaw member 7 constrain the first jaw member to move within defined limits. The apertures and cams are shown as causing angled movement of the first jaw member although only vertical movement of the first jaw member is necessary for operation of the invention.

Figure 5:
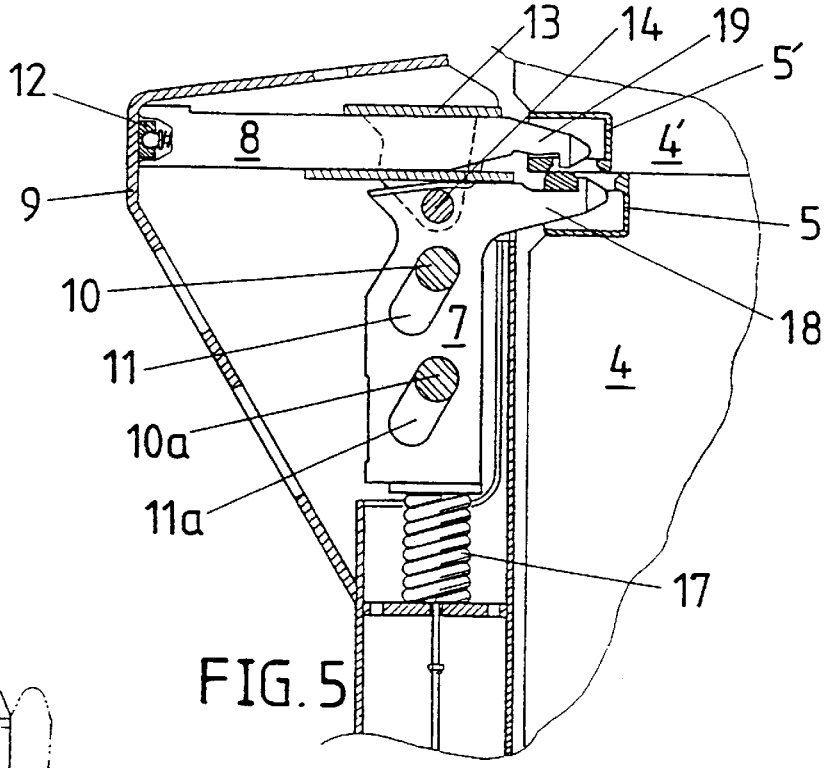
FIG. 5 is a detailed view of the embodiment of FIG. 3 in the loaded position lifting two containers.

The second jaw member 8 is pivotally mounted to the body 9 at pivot 12. A connection means 13 captively connects the second jaw member 8 to the first jaw member 7. The connection means 13 is pivotally connected to the first jaw member by pin 14 and captures the second jaw member 8 intermediate its ends. In the preferred embodiment the connection means 13 is a guide bracket that guides the movement of the second jaw member between an extended position, as shown in FIG. 3, and a retracted position, as shown in FIG. 5. A spring 15 on a guide rod 16 biases the second jaw member 8 towards the extended position.

The first and second jaw members are biased towards an open position by spring 17. Application of a load to the first jaw member overcomes the action of the spring 17 and causes the first and second jaw members to move towards a closed position.

Figure 4:
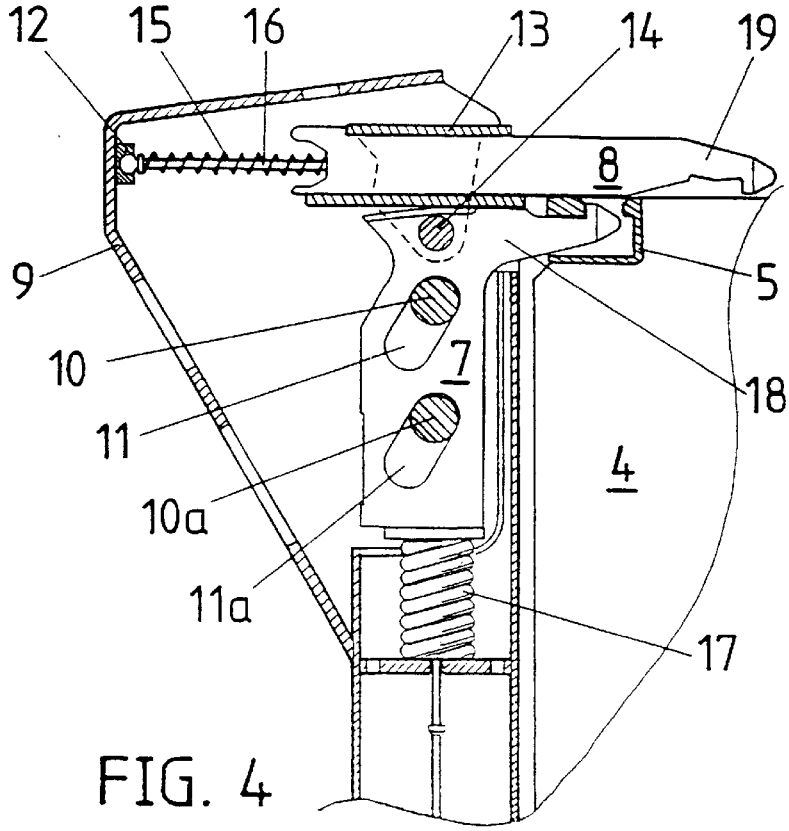
FIG. 4 is a detailed view of the embodiment of FIG. 3 in the loaded position lifting a single container.

In FIG. 4 the load applied is a container 4 and the first jaw member 7 engages the coupling piece 5. A distal portion of the first jaw member is shaped as a hook 18 to facilitate the engagement of the coupling piece. In use, the forklift driver directs the first jaw member into the coupling piece of the container. Raising of the lift 2 causes the first jaw member 7 to retract on cams 10, 10*a* and lift slightly to engage the coupling means 5. Concurrently, the connection means 13 causes the second jaw member 8 to move cooperatively with the first jaw member. The pivotal connection 12 restrains one end of the second jaw member so that it pivots into the clamping position as shown in FIG. 4.

Although the first jaw member 7 is shown in the preferred embodiment as moving at an angle, it will be appreciated that the horizontal movement is not essential to the operation of the invention. Furthermore, it will be appreciated that the handling assembly 1 moves relative to the container 4 while the first jaw member 7 does not move vertically until the cams 10 and 10*a* engage the ends of the apertures 11 and 11*a*, thereby lifting the first jaw member 7 and container 4.

It will be appreciated that in lifting a single container a corresponding jaw member 7' at the other end of spreader bar 6 will locate into a respective coupling piece at the other end of the container. When the forklift driver can see that the jaw members 7, 7' are within the coupling piece 5 the lift 2 is raised thereby raising the handling assembly 1 and container 4.

Unloading of a single container is a reversal of the loading procedure. Once the container 4 is lowered onto the ground, further lowering of lift 2 forces the first Jaw member 7 to disengage from the coupling piece 5. Concurrently, the spring 17, pivotal connection 12 and connection means 13 combine to urge the jaw members to an open position.

In the case of lifting two containers the second jaw member 8 is positioned in coupling piece 5' of upper container 4'. A distal portion of the second jaw member is shaped as a hook 19 to facilitate engagement of the coupling piece. This operation is much easier than with prior art devices because the second jaw member 8 projects beyond the first jaw member 7. Location of the hook 19 into a coupling piece 5' located at the top of an eight container stack is difficult if the view is obscured by the first jaw member 7.

Once the second jaw member 8 is located in the coupling piece 5' it retracts in guide 9 as the forklift driver urges the forklift forward to locate the first jaw member 7 in the coupling piece 5. The lift 2 is raised as described above causing the jaw members 7 and 8 to clamp the two containers 4 and 4' as shown in FIG. 5. The position of the second jaw member 8 relative to the first jaw member 7 adjusts automatically to account for relative lateral displacements of containers 4 and 4'.

Figure 6:
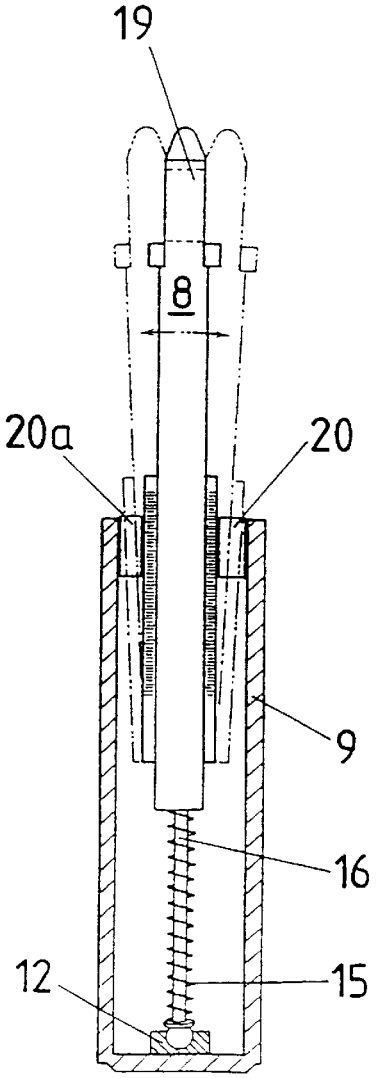
FIG. 6 is a first sectional top view of the embodiment of FIG. 3.

The jaw members also account automatically for transverse displacements of the containers. FIG. 6 shows a partial top view of the body 9 in the vicinity of second jaw member 8. Compensating spring means 20 and 20*a* act on the sides of the second jaw member 8 to urge it towards a normal central position, as shown. If the second jaw member enters the coupling piece at an angle or off-centre the spring means 20, 20*a* compensate by allowing the second jaw member to displace left or right as required. The shape of the hook 19 aids in correcting misalignment. Once removed from the coupling piece the compensating spring means return the second jaw member to the central position.

Figure 7:
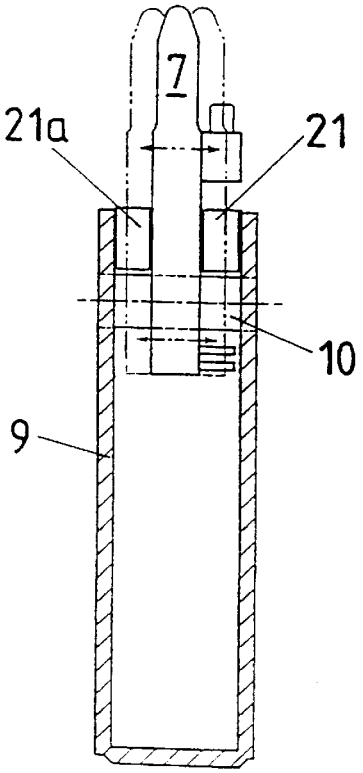
FIG. 7 is a second sectional top view of the embodiment of FIG. 3.

FIG. 7 shows a partial top view of the body 9 in the vicinity of first jaw member 7. Compensating spring means 21 and 21 a act on the sides of the first jaw member 7 to urge it towards a normal central position, as shown. The action of the spring means 21 and 21 a is identical to the action of spring means 20 and 20*a* described above.

Compensating spring means 20, 20*a*, 21 and 21*a* may be conventional coil springs, polyurethane blocks or similar members.

Figure 8:
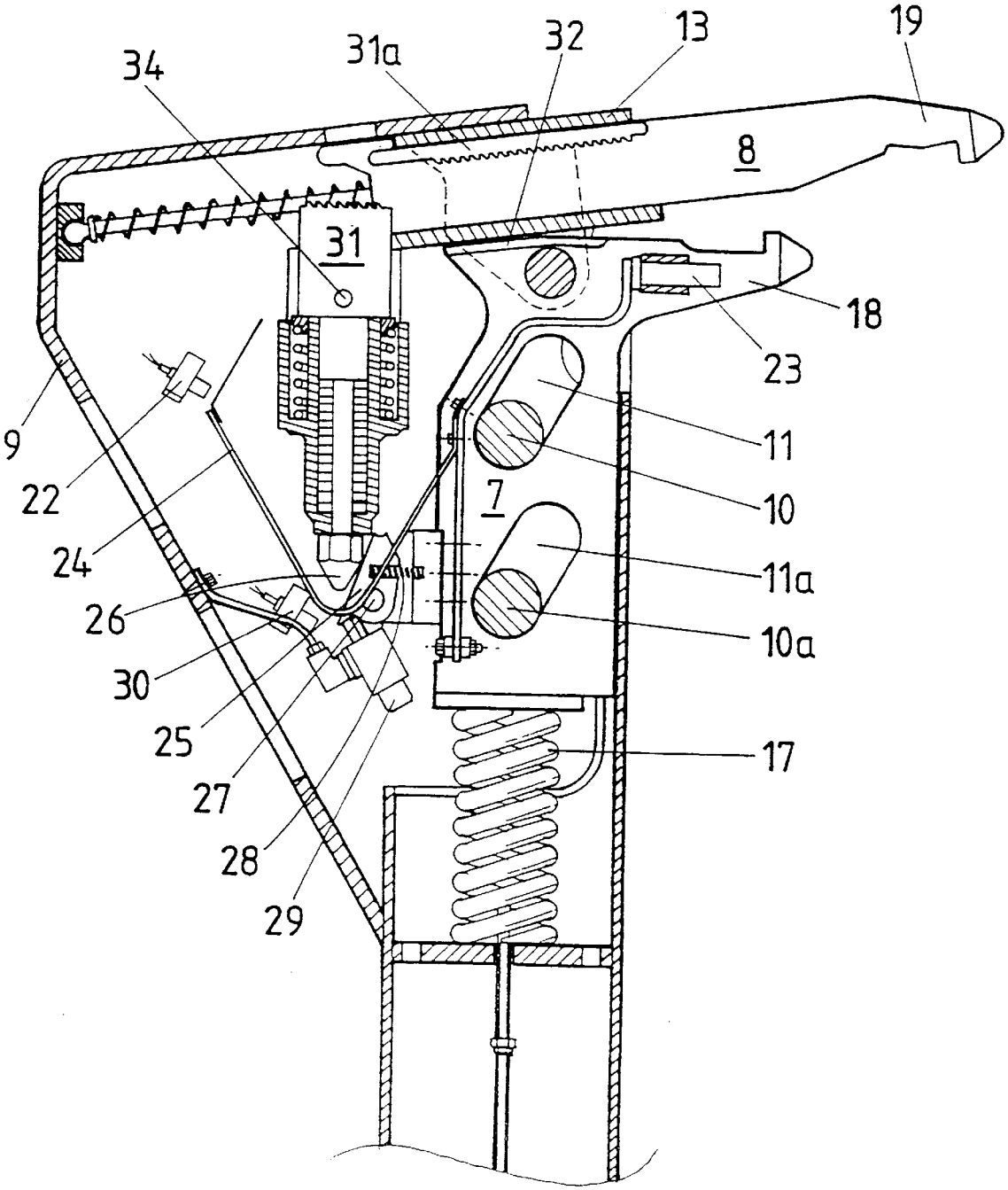
FIG. 8 is a detailed view of a second embodiment of the handling assembly in the unloaded position.
Figure 9:
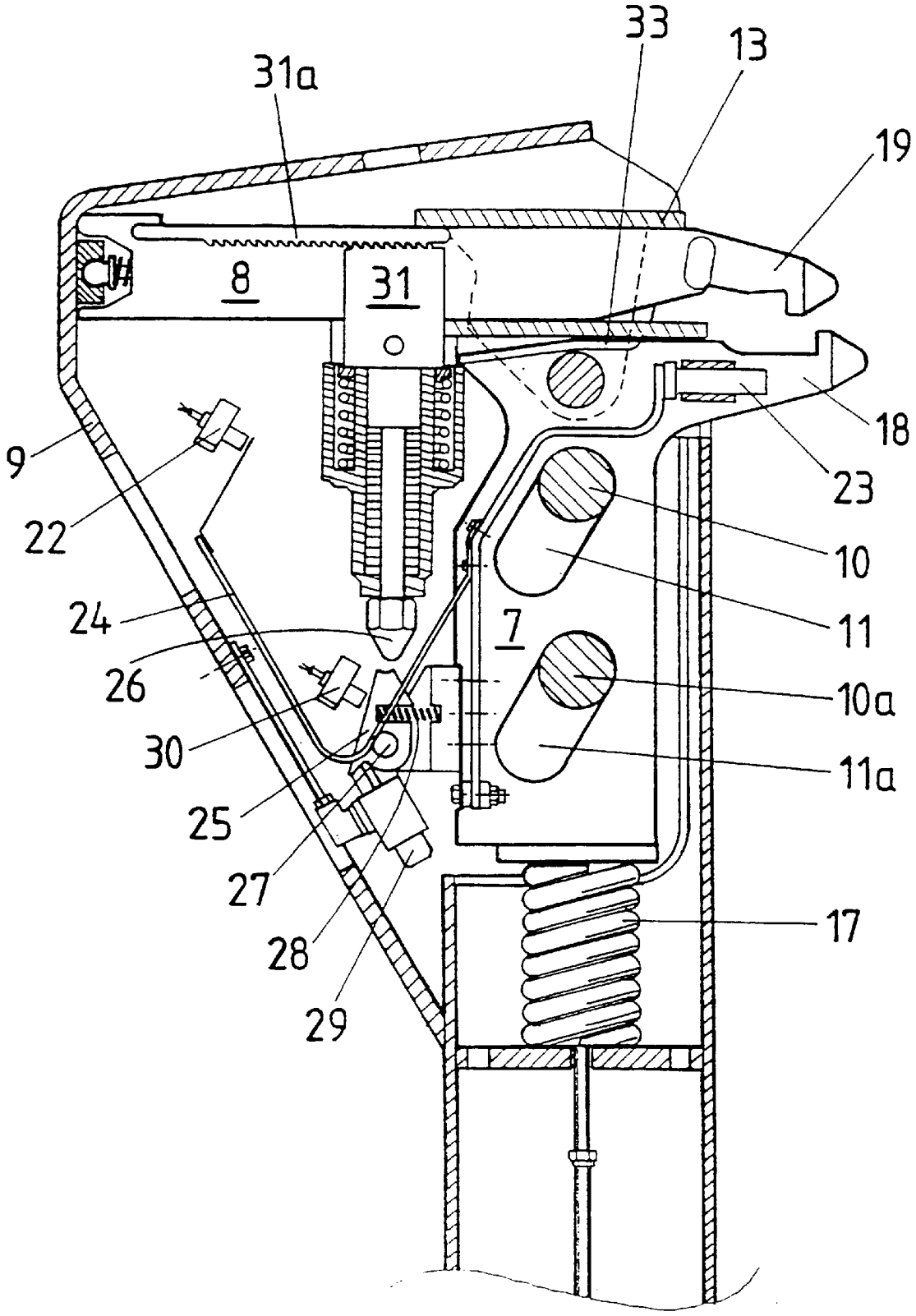
FIG. 9 is a detailed view of the embodiment of FIG. 6 in the loaded position.

To further enhance the safety of the invention a number of features are added to the invention as shown in FIG. 8 and FIG. 9. A proximity switch 22 provides a signal in the forklift cabin when the jaws are closed and correctly loaded. A stop 23 on the first jaw member 7 is connected to a plate 24 that contacts the proximity switch 22 when the first jaw member is in the loaded position, as shown in FIG. 9. The signal is in the form of a light which changes colour when the first jaw member is correctly seated at the extent of movement allowed by the apertures 11, 11*a* moving on cams 10, 10*a*. If the light in the cabin is red the forklift operator knows that the container handling assembly 1 is not ready for pick-up. When the light goes green the forklift operator can commence the lift of the containers.

A locking block 25 is provided to prevent premature unloading of containers from the container handling assembly. As can be seen in FIG. 8, the locking block 25 is in an unlocked position in the absence of a container. When the body 9 is raised and a load is applied to the first jaw member 7 the locking block 25 moves relative to the stop 26. When the first jaw member is at the limit of movement permitted by the cams 10, 10*a* and apertures 11, 11*a* the locking block 25 clears the stop 26 and the pivots forward on pin 27 under influence of spring 28. A container cannot be unloaded from the container handling assembly while the locking block 25 is in this position. If the body 9 is lowered the stop 26 comes into contact with the locking block 25 thereby preventing movement of the first jaw member 7 relative to the body 9.

In order to unload a container the forklift operate must activate solenoid 29 to pivot the locking block 25 thereby allowing the locking block 25 to clear the stop 26. A sensor 30 provides a signal in the forklift cabin to indicate when the locking block 25 is in the locked position.

As previously described, the second jaw member 8 is able to move between an extended and a retracted position. A retaining means is provided to prevent the second jaw member from moving towards the extended position while in the loaded position. The retaining means comprises a toothed member 31 connected to the body 9. Corresponding toothed portion 31*a* engages the toothed portion 31 when the second jaw member is in the retracted position and the jaws are closed, thereby minimising the possibility of movement of the second jaw member.

In the open position the second jaw member 8 rests upon a first bearing face 32 of the first jaw member 7, as shown in FIG. 8. In the closed position, the second jaw member 8 rests on a second bearing surface 33 of the first jaw member 7, as shown in FIG. 9. It will be appreciated that if the first jaw member 7 is not correctly seated, and lifting of one or two containers commences, there will be considerable load on the second jaw member, possibly causing it to bend at the junction between the bearing faces 32 and 33. To ameliorate this possibility the second jaw member contacts a spring loaded support rod 34 before contacting the second bearing surface 33. The spring loaded support rod 34 provides cushioning of the load on the second jaw member.

The container handling assembly described herein offers a number of advantages over known container handling devices. The cooperating jaw assembly ensures that containers are firmly held during the lift operation. Furthermore, the safety features minimise the chance of the containers dislodging during transport. Throughout the specification the aim has been to describe the preferred embodiments of the invention without limiting the invention to any one embodiment or specific collection of features.

What is claimed is:

1. A container handling assembly for lifting containers having coupling pieces comprising:

a body;

means for connecting a first jaw member to the body and allowing relative vertical movement between the first jaw member and the body;

means for pivotally connecting a second jaw member to the body adjacent one end of the second jaw member; and connection means captively connecting the first and second jaw members;

wherein said connection means is pivotally connected to the first jaw member and captures the second jaw member intermediate the ends thereof, said second jaw member being slidable in said connection means between an extended and a retracted position, whereby raising of the body when the first jaw member is engaged in a coupling piece of a container causes the second jaw member to move towards a closed position by movement of the body relative to the first jaw member and cooperative pivoting of the second jaw member towards the first jaw member.

2. The container handling assembly of claim 1 wherein the body includes attachment means for attachment of the body to a lift mechanism of a forklift truck.

3. The container handling assembly of claim 1 wherein the second jaw member projects beyond the first jaw member when in an open position.

4. The container handling assembly of claim 1 further comprising bias means that biases the first and second jaw members towards an open position.

5. The container handling assembly of claim 1 wherein the first jaw member is slidably mounted on cams connected to the body.

6. The container handling assembly of claim 1 wherein the first jaw member is movable between an extended and a retracted position and wherein the first jaw member is extended in an open position and retracted the closed position.

7. The container handling assembly of claim 1 wherein the second jaw member is transversely deflectable to compensate for misalignment between the second jaw member and a further coupling piece of a further container.

8. The container handling assembly of claim 1 further comprising bias means that biases the second jaw member towards the extended position.

9. The container handling assembly of claim 1 wherein the connection means comprises a guide means and the second jaw member is constrained by the guide means to move between the extended position and the retracted position.

10. The container handling assembly of claim 1 further comprising retaining means for retaining the second jaw member in the retracted position when the first and second jaw members are in the closed position.

11. The container handling assembly of claim 1 further comprising a hook portion in a distal end of the first jaw member and a further hook portion in the end of the second jaw member distal the pivotal connection to the body.

12. The container handling assembly of claim 1 further comprising indicator means indicative of a load being correctly applied to the first jaw member.

13. The container handling assembly of claim 1 further comprising safety means for preventing premature unloading of the first jaw member.

14. The container handling assembly of claim 13 further comprising second indicator means indicative of the operation of the safety means.

15. The container handling assembly of claim 1 wherein the first jaw member is transversely deflectable to compensate for misalignment.

16. A container handling assembly for lifting containers having coupling pieces comprising:

a body including attachment means for attachment of the body to a lift mechanism of a forklift truck;

means for slidably connecting a first jaw member to the body said first jaw member engaging a coupling piece of a lower container;

means for pivotally connecting a second jaw member to the body adjacent one end of the second jaw member, said second jaw member engaging a coupling piece of an upper container placed above the lower container; and connection means captively connecting the first and second jaw members, said connection means being pivotally connected to the first jaw member and capturing the second jaw member intermediate the ends thereof; whereby raising the body causes a load to be applied to the first jaw member engaging said coupling piece of said first container and causes pivoting of said second jaw member about said one end of said second jaw member until said second jaw member moves to a closed position relative to said first jaw member.

17. A container handling assembly for lifting a first container and a second container stacked above said first container comprising:

a body including attachment means for attachment of the body to a lift mechanism of a forklift truck;

means for slidably connecting a first jaw member to the body, said first jaw member engaging a coupling piece of the first container;

means for pivotally connecting a second jaw member to the body adjacent one end of the second jaw member, said second jaw member engaging a coupling piece of the second container above said coupling piece of said first container and said second jaw member being slidable between an extended and a retracted position but residing in the extended position when not engaged with said coupling piece of said second container;

connection means captively connecting the first and second jaw members, wherein said connection means is pivotally connected to the first jaw member and captures the second jaw member intermediate the ends thereof, whereby raising the body causes a load to be applied to the first jaw member engaging said coupling piece of said first container and causes pivoting of said second jaw member about said one end of said second jaw member until said second jaw member moves to a closed position relative to said first jaw member.

* * * * *